US006385323B1

(12) United States Patent
Zoels

(10) Patent No.: US 6,385,323 B1
(45) Date of Patent: May 7, 2002

(54) HEARING AID WITH AUTOMATIC MICROPHONE BALANCING AND METHOD FOR OPERATING A HEARING AID WITH AUTOMATIC MICROPHONE BALANCING

(75) Inventor: Fred Zoels, Altenthann (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 0 days.

(21) Appl. No.: 09/310,125

(22) Filed: May 12, 1999

(30) Foreign Application Priority Data

May 15, 1998 (DE) ..... 198 22 021

(51) Int. Cl.[7] ..... H04R 25/00

(52) U.S. Cl. ..... 381/313; 381/57; 381/91; 381/92; 381/120

(58) Field of Search ..... 381/312, 313, 381/314, 57–58, 91–92, 95, 102, 104, 107, 120–122, 170, 356–358, 320–321, 83, 93, FOR 127, FOR 128, FOR 129, FOR 130, FOR 131

(56) References Cited

U.S. PATENT DOCUMENTS 4,357,492 A * 11/1982 Campbell et al. ..... 381/92
5,029,215 A * 7/1991 Miller, II ..... 381/92
5,170,434 A * 12/1992 Anderson ..... 381/68
5,515,445 A 5/1996 Baumhauer, Jr. et al.

OTHER PUBLICATIONS

"Audio Zoom–Signal Processing for Improved Communications in Noise," Bächler et al., Phonak Focus, vol. 18 (1995).

* cited by examiner

*Primary Examiner*—Sinh Tran
*Assistant Examiner*—P. Dabney
(74) *Attorney, Agent, or Firm*—Schiff Hardin & Waite

(57) ABSTRACT

A hearing aid has a signal processing unit, an earphone and at least two microphones whose output signals are subtracted from one another in a first difference element in order to achieve a directional microphone characteristic, and a difference element subtracts average values of the output signals of the microphones and supplies a signal to an analysis/control unit for controlling the amplification of the output signal of at least one of the microphones that follows the second difference element. In a method for the operation of a hearing aid having automatic microphone balancing, following formation of average values proceeding from the output signals of the microphones, the deviation of the average values from one another is identified and the amplification of at least one output signal of a microphone is adjusted until coincidence of the average values occurs.

16 Claims, 1 Drawing Sheet

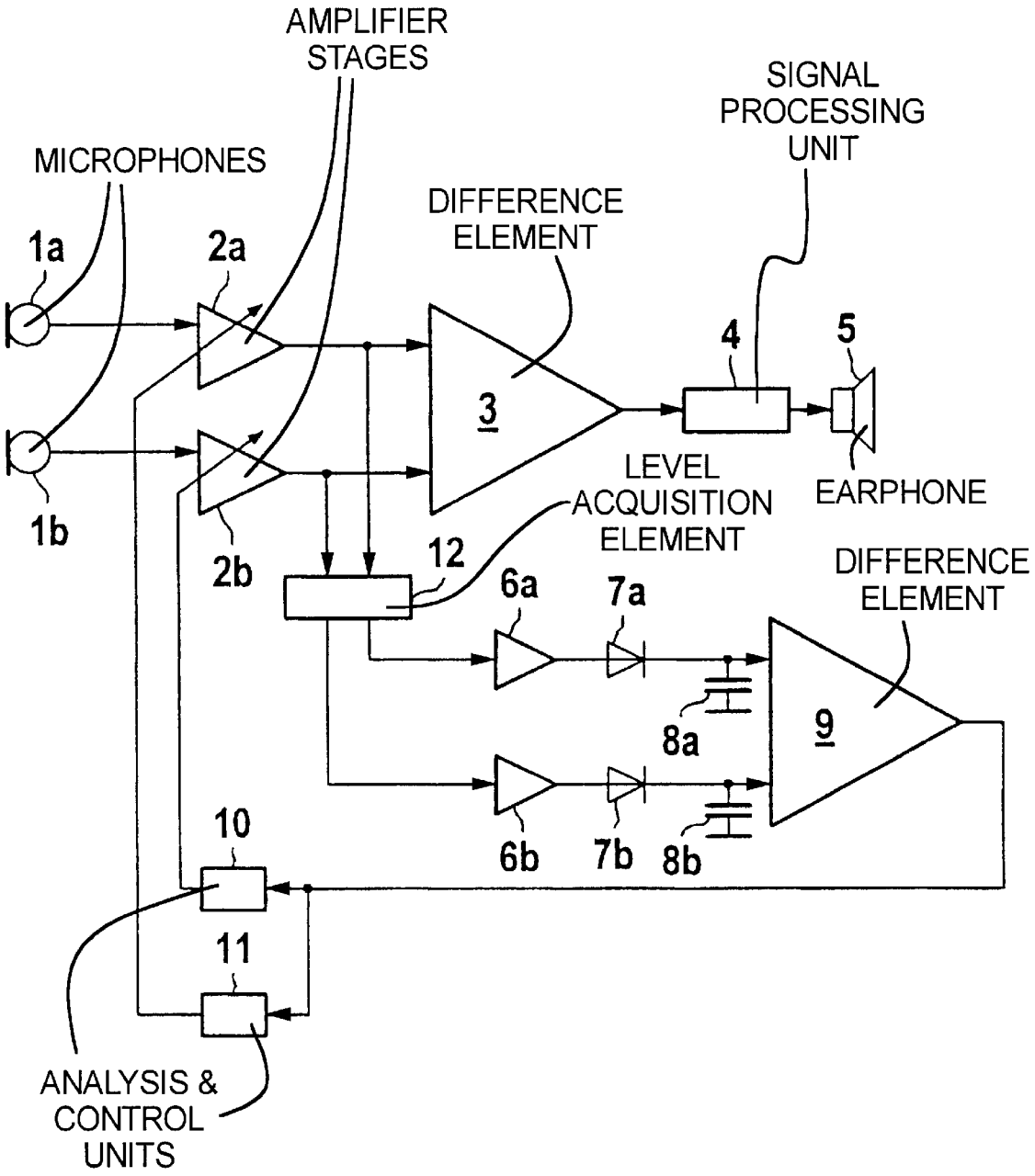
AMPLIFIER STAGES
SIGNAL PROCESSING UNIT
MICROPHONES
DIFFERENCE ELEMENT
1a
2a
4
5
3
1b
2b
LEVEL ACQUISITION ELEMENT
EARPHONE
12
6a
7a
DIFFERENCE ELEMENT
8a
9
10
6b
7b
8b
11
ANALYSIS & CONTROL UNITS

HEARING AID WITH AUTOMATIC MICROPHONE BALANCING AND METHOD FOR OPERATING A HEARING AID WITH AUTOMATIC MICROPHONE BALANCING

BACKGROUND OF THE INVENTION

1. Field of the Invention

The present invention is directed to a hearing aid of the type having two microphones with automatic balancing of the output signals of the respective microphones, as well as to a method for operating such a hearing aid.

2. Description of the Prior Art

Hearing aids are known wherein a subtraction of the signals of two omni-directional microphones ensues for producing a directional microphone characteristic. The desired directional microphone characteristic of the hearing aid arises due to the phase difference which occurs as a result of the different transit times of the microphone signals.

In order to achieve a directional microphone characteristic, the two microphones of the hearing aid must exhibit identical frequency responses and sensitivities. It is therefore necessary to employ microphone pairs and microphone groups that are specifically selected and adapted to one another. Nevertheless, an undesired shift of the directional microphone characteristic due to different post-assembly modification of the characteristics of the individual microphones, for example due to aging, temperature or radiation influences, cannot be avoided.

SUMMARY OF THE INVENTION

An object of the present invention is to provide a hearing aid as well as a method for the operation of a hearing aid wherein an undesired change of the directional microphone characteristic of the hearing aid is avoided.

In the inventive hearing aid and method, a first difference element is used to subtract the respective signals from two microphones, with the output of this first difference element being supplied to the earphone of the hearing aid, and a subtraction of average values of the output signals of the microphones ensues with a second difference element. Proceeding from the identified deviation of the average values of the output signals of the microphones, the amplification of the output signal of at least one of the microphones is regulated by an analysis/control unit following the second difference element until no deviation of the average values of the output signals of the microphones subtracted from one another can be found following the second difference element.

This makes it possible to combine more economical microphones that are not precisely adapted to one another into microphone pairs or microphone groups in a hearing aid, and to recognize and eliminate the differences of the characteristics of the microphones, for example in the frequency response or in the sensitivity, that exist from the very start or occur during the useful life.

The manufacturing costs are lowered by expanding the combination possibilities of different microphones. Further, modifications in the characteristics occurring during the useful life of the microphones can be recognized and corrected, so that a uniformly high microphone quality and accurate directional microphone characteristic is achieved over the entire service life of the hearing aid.

In one embodiment, an adjustable amplifier element for controlling the amplification of the corresponding output signal is allocated to at least one of the microphones.

Average values of the output signals of the microphones are subtracted from one another in the second difference element of the inventive hearing aid. The output signals of the microphones are preferably rectified before being supplied as input signals to the second difference element.

In another embodiment, the analysis/control unit is an I-regulator, so that a constant repetitive error is not obtained in the control event. For further stabilization of the control event, the analysis/control unit can be a PI regulator.

The level of the output signals of the microphones and/or of the output signal of the second difference element can be acquired via a level acquisition element such as a threshold element, in order, for example, to cut-in the automatic microphone balancing only after upward transgression of a minimum level.

In another embodiment, the output signals of the microphones pass through a filter element (for example, a low-pass filter or a bandpass filter) with which the control event of the inventive hearing aid is activated in an identified frequency range.

In the inventive method, average values are initially formed proceeding from the output signals of the microphones. Subsequently, the deviation of the average values from one another is identified and the amplification of at least one of the output signals of a microphone is potentially controlled as needed in order to reduce the deviation of the average values and, ultimately, to eliminate it.

For example, the RMS values (root mean square) or peak values can be employed as average values of the output signals. A balancing of the RMS values is more complicated but is also more precise, whereas a balancing of the peak values can ensue within a shorter time.

In an embodiment of the method, the amplification, in particular, of the less sensitive microphone is boosted when a deviation of the average values from one another is found. The less sensitive microphone given a hearing aid with two microphones can be identified on the basis of the operational sign of the deviation of the average values.

The signal amplification of a number of microphones can be adjusted in the same or opposite directions for automatic microphone balancing.

In order to avoid the intrinsic low level noise of the microphones from being amplified, the inventive method for the automatic microphone balancing can be activated only when an adjustable minimum level is upwardly transgressed.

When this level is downwardly transgressed, an optimum amplification (gain value) for the output signals of the individual microphones that has already been identified or stored can be set. The optimum individual amplification of the output signals of the microphones is again individually identified only when the limit level value is exceeded.

In order to avoid distortions, it can also be advantageous not to implement any automatic microphone balancing outside of an identifiable frequency range. Thus, for example, the inventive method can be implemented only in a specific frequency range on the basis of a bandpass filter.

DESCRIPTION OF THE DRAWINGS

The single FIGURE is a block circuit diagram of a hearing aid with automatic balancing of the output signals of the microphones, constructed and operating in accordance with the principles of the present invention.

DESCRIPTION OF THE PREFERRED EMBODIMENTS

The drawing shows a schematic circuit diagram for a hearing aid having two microphones 1*a* and 1*b* whose output signals are supplied to a first difference element 3 via adjustable amplifier stages 2*a* and 2*b*. The output signal of the first difference element 3 has a directional characteristic and is further-processed in a signal processing unit 4 in order to be supplied to an earphone 5.

Inventively, the output signals of the two amplifier stages 2*a* and 2*b* are also supplied to a second difference element 9 via two rectifier stages that are respectively composed of balancing elements 6*a*, 6*b*, absolute value-forming units 7*a*, 7*b* and filters 8*a*, 8*b*. Following the two rectifier stages, which can also be fashioned with digital components, the output signals are subtracted from one another in the second difference element 9 in order to identify any deviation therebetween. Different average values of the output signals (for example, RMS values or peak values) can be generated via further signal processing elements preceding the second difference element 9.

The output signal of the second difference element is supplied to analysis/control units 10 and 11 in order, via a corresponding control of one or both amplifier stages 2*a* and 2*b*, to reduce the deviation of the average values found subsequently in a second subtraction in the second difference element 9, and ultimately to eliminate any deviation. A further signal analysis of the output signal of the second difference element 9, for example with reference to further parameters, can also ensue in the analysis/control units 10 and 11 in order, for example, to select a suitable type of regulator (for example I-regulator).

The analysis/control units 10 and 11 also can be connected to the signal processing unit 4 with signal lines (not shown) in order to achieve an optimization of the overall signal processing in the hearing aid via a data exchange.

Via a filter element (not shown), an adjustable frequency range of the output signals of the amplifier stages 2*a* and 2*b* is supplied to the second difference element 9, so that, for example, especially high or especially low frequencies can be blanked out. An undesired distortion that can occur given automatic microphone balancing in these limit frequency ranges is thus avoided.

Via a threshold element, a determination can be made in the level acquisition element 12 to activate the automatic microphone balancing by the control in the analysis/control units 10 and 11 only beginning at a specific minimum level, in order to avoid amplification of the intrinsic noise of the microphones 1*a* and 1*b* at low levels.

Alternatively, only a single analysis/control 10 can also be provided, this being connected (not shown) to both amplifier stages 2*a* and 2*b*.

A filter element (not shown) and the level acquisition element 12 can be connected in common with the second difference element 9 and the analysis/control units 10 and/or 11 in order to achieve a corresponding overall balancing (not shown) of the automatic microphone balancing.

Although modifications and changes may be suggested by those skilled in the art, it is the intention of the inventor to embody within the patent warranted hereon all changes and modifications as reasonably and properly come within the scope of his contribution to the art.

I claim as my invention:

1. A hearing aid comprising:

at least a first microphone and a second microphone which respectively produce microphone output signals;

a first difference-forming element, supplied with said output signals from said first and second microphones, for subtracting said output signals from each other to form an output signal representing a directional microphone characteristic;

an earphone supplied with said output signal from said first difference-forming element;

a second difference-forming element wherein average values of said output signals of said first and second microphones are subtracted from each other to produce an output; and an analysis and control unit supplied with said output from said second difference-forming element which controls amplification of the output signal of at least one of said first microphone and said second microphone.

2. A hearing aid as claimed in claim 1 further comprising at least one adjustable amplifier, supplied with an output signal from said analysis and control unit, connected between one of said first microphone and said second microphone and said first difference-forming unit.

3. A hearing aid as claimed in claim 1 further comprising a first rectifier connected between said first microphone and said second difference-forming unit for rectifying said output signal of said first microphone, and a second rectifier connected between said second microphone and said second difference-forming unit for rectifying said second output signal from said second microphone.

4. A hearing aid as claimed in claim 1 wherein said analysis and control unit comprises an I-regulator.

5. A hearing aid as claimed in claim 1 wherein said analysis and control unit comprises a PI regulator.

6. A hearing aid as claimed in claim 1 further comprising a level acquisition element connected between said first and second microphones and said second difference-forming element for identifying a level of the output signals of said first and second microphones and for passing said output signals of said first and second microphones to said second difference-forming element dependent on said level.

7. A hearing aid as claimed in claim 6 wherein said level acquisition element comprises a threshold element.

8. A hearing aid as claimed in claim 1 wherein said output signal of said first and second microphones each have a frequency range, and further comprising a filter element connected between said first and second microphones and said second difference-forming element for limiting a frequency of said output signals of said first and second microphones supplied to said second difference-forming element.

9. In a hearing aid having at least first and second microphones, each of which emits an output signal, a first difference-forming element supplied with the output signals of said first and second microphones for subtracting said output signals from each other to produce an output signal representing a directional microphone characteristic, and an earphone supplied with the output signal from said first difference-forming element, a method for automatically balancing the output signals from said first and second microphones comprising the steps of:

forming a first average value of the output signal from said first microphone and forming a second average value of the output signal from said second microphone;

identifying any deviation of said first average value from said second average value; and amplifying at least one of the respective output signals from said first and second microphones until said average values coincide.

10. A method as claimed in claim 9 wherein the step of forming said first average value comprises forming an average value of RMS values of said output of said first microphone and wherein the step of forming said second average value comprises forming an average value of RMS values of said output signal from said second microphone.

11. A method as claimed in claim 9 wherein the step of forming said first average value comprises forming an average value of peak values of said output of said first microphone and wherein the step of forming said second average value comprises forming an average value of peak values of said output signal from said second microphone.

12. A method as claimed in claim 9 comprising the additional step of identifying one of said first and second microphones as being a less sensitive microphone, and wherein the step of amplifying the output signal of at least one of said first and second microphones comprises amplifying the output signal from said less sensitive microphone.

13. A method as claimed in claim 12 wherein said hearing aid comprises only said first microphone and said second microphones, and wherein the step of identifying said less sensitive microphone comprises identifying an operational sign of said deviation of said average values from each other.

14. A method as claimed in claim 9 comprising the additional steps of monitoring a level of said output signals of said microphones and conducting the step of identifying any deviation of said average values from each other only when said level of said output signals exceeds a predetermined level.

15. A method as claimed in claim 14 comprising the additional step of, when said level of said output signals is below said predetermined level, identifying and storing a plurality of optimum amplification values for said output signals of said first and second microphones and wherein the step of amplifying at least one of said output signals of said first and second microphones comprises using one of said stored optimum values.

16. A method as claimed in claim 9 wherein said output signals of said first and second microphones exhibit a frequency which varies within a frequency range, and wherein the step of identifying any deviations of said average values from each other comprises identifying any deviations of said average values from each other in an adjustable frequency range within said frequency range of said output signals of said first and second microphones.

* * * * *